United States Patent [19]

Ishinabe et al.

[11] Patent Number: 4,971,213

[45] Date of Patent: Nov. 20, 1990

[54] PLASTIC CAP

[75] Inventors: Masao Ishinabe, Atsugi; Sumio Takeishi, Yokohama; Takashi Yazaki, Hiratsuka; Kiyoshi Kawaguchi, Yokohama, all of Japan

[73] Assignee: Japan Crown Cork Co., Ltd., Tokyo, Japan

[21] Appl. No.: 320,645

[22] PCT Filed: Apr. 21, 1988

[86] PCT No.: PCT/JP88/00389

§ 371 Date: Dec. 21, 1988

§ 102(e) Date: Dec. 21, 1988

[87] PCT Pub. No.: WO88/08397

PCT Pub. Date: Nov. 3, 1988

[30] Foreign Application Priority Data

Apr. 21, 1987 [JP] Japan ..... 62-96324

[51] Int. Cl.[5] ..... B65D 41/04

[52] U.S. Cl. ..... 215/344; 215/DIG. 1

[58] Field of Search ..... 215/341, 343, 344, 345, 215/DIG. 1

[56] References Cited

U.S. PATENT DOCUMENTS

| | | | |
|---|---|---|---|
| 3,568,871 | 3/1971 | Livingstone | 215/DIG. 1 |
| 4,340,149 | 7/1982 | Mori et al. | 215/343 |
| 4,429,802 | 2/1984 | Marks | 215/DIG. 1 |
| 4,598,835 | 7/1986 | Brownbill | 215/DIG. 1 |

FOREIGN PATENT DOCUMENTS

| | | | |
|---|---|---|---|
| 835434 | 5/1960 | United Kingdom | 215/344 |
| 929083 | 6/1963 | United Kingdom | 215/341 |
| 1584265 | 2/1981 | United Kingdom | 215/DIG. 1 |
| 2133394 | 7/1984 | United Kingdom | 215/344 |

*Primary Examiner*—Stephen Marcus

*Attorney, Agent, or Firm*—Sughrue, Mion, Zinn, Macpeak and Seas

[57] ABSTRACT

Disclosed is a plastic cap comprising a top plate and a skirt hanging down from the peripheral edge of the top plate, which are integrally formed of a plastic material, and a mechanism for clamping the cap to a vessel, which is arranged on the inner circumferential face of the skirt, wherein a receiving seat to be substantially exactly engaged with the top edge or peripheral edge of the vessel mouth and at least one sealing projection protruding from the receiving seat through a groove by a very small distance from the face of the receiving seat are arranged in an inner corner portion between the top plate and the skirt or in the vicinity thereof, and sealing is effected by the pressure generated by compression deformation of the sealing projection. In this plastic cap, plastic deformation of the sealed portion is prevented and a high durable sealing pressure is obtained. Accordingly, this plastic cap has an excellent pressure-resistant sealing property and an excellent venting property in combination.

9 Claims, 4 Drawing Sheets

PLASTIC CAP

TECHNICAL FIELD

The present invention relates to a plastic cap. More particularly, the present invention relates to a plastic cap in which plastic deformation of the sealed portion is prevented and a high durable sealing pressure is attained, especially a plastic cap which has an excellent pressure-resistant sealing property and an excellent venting property (gas vent property) in combination.

TECHNICAL BACKGROUND

A plastic cap comprising a top plate and a skirt hanging down from the peripheral edge of the top plate, which are integrally formed of a plastic material, and a clamping mechanism attached to the inner circumferential face of the skirt, is widely used as the cap for various bottled products, because sealing is accomplished between a vessel mouth and the cap without using a liner or packing. However, an ordinary plastic cap is still insufficient in the pressure-resistant sealing property for a content having an autogeneous pressure, such as a carbonated drink. A plastic cap excellent in the pressure-resistant sealing property, which can be applied to a carbonated drink vessel, has already been proposed. For example, Japanese Patent Application Laid-Open Specification No. 73551/83, Japanese Patent Application Laid-Open Specification No. 216552/83 and Japanese Patent Application Laid-Open Specification No. 187552/84 disclose a plastic cap having a seal lip or flap piece of a specific shape attached to the inner face of a top plate at a portion to be engaged with a vessel mouth.

In each of known caps of this type having a pressure-resistant sealing property, the above-mentioned seal lip or flap piece is engaged with the vessel mouth over a considerable distance in the direction of the vessel mouth, and as the vessel mouth is inserted, the engaging pressure between the vessel mouth and the seal lip or flap piece increases.

However, in the plastic cap of the conventional engagement system, deformation of the seal lip or flap piece is large and the engagement is produced over a considerable distance in the direction of insertion of the vessel mouth. Therefore, plastic deformation of the sealed portion is often caused, and the high initial sealing pressure is gradually reduced and the cap is defective in that a high durable sealing pressure as expected cannot be obtained.

In the case where the plastic cap of the conventional engagement system is applied to a carbonated drink-filled vessel, troubles such as blow-off of the content and spring-out of the cap are often observed. Namely, it is known that in the case where a canned or bottled product filled with a carbonated drink or beer is opened, if the gas in the head space is gradually released, blow-off of the content is controlled, but if opening is performed abruptly in a moment, blow-off of the content is caused. In the cap of the above-mentioned engagement system, since the seal lip or flap piece is engaged with the vessel mouth over a certain distance, even if the cap is turned for opening, sealing is not released and the gas in the head space is not released. It is considered that for this reason, troubles such as blow-off of the content and spring-out of the cap are caused.

OBJECTS OF THE INVENTION

It is therefore a primary object of the present invention to provide a plastic cap in which a high durable sealing pressure is produced by the pressure generated by slight compression deformation of the sealed portion, an especially excellent pressure-resistant sealing property is realized, and at the time of opening, the gas is vented and occurrence of troubles such as blow-off of the content and spring-out of the cap is prevented.

Another object of the present invention is to provide a plastic cap having an excellent reduced-pressure sealing property, which is suitable for sealing the content maintained under vacuum.

CONSTRUCTION OF THE INVENTION

In accordance with the present invention, there is provided a plastic cap comprising a top plate and a skirt hanging down from the peripheral edge of the top plate, which are integrally formed of a plastic material, and a mechanism for clamping the cap to a vessel, which is arranged on the inner circumferential face of the skirt, wherein a receiving seat to be substantially exactly engaged with the top edge or peripheral edge of the vessel mouth and at least one sealing projection protruding from the receiving seat through a groove by a very small distance from the face of the receiving seat are arranged in an inner corner portion between the top plate and the skirt or in the vicinity thereof, and sealing is effected by the pressure generated by compression deformation of the sealing projection.

DETAILED DESCRIPTION OF THE INVENTION

Figure 1A:
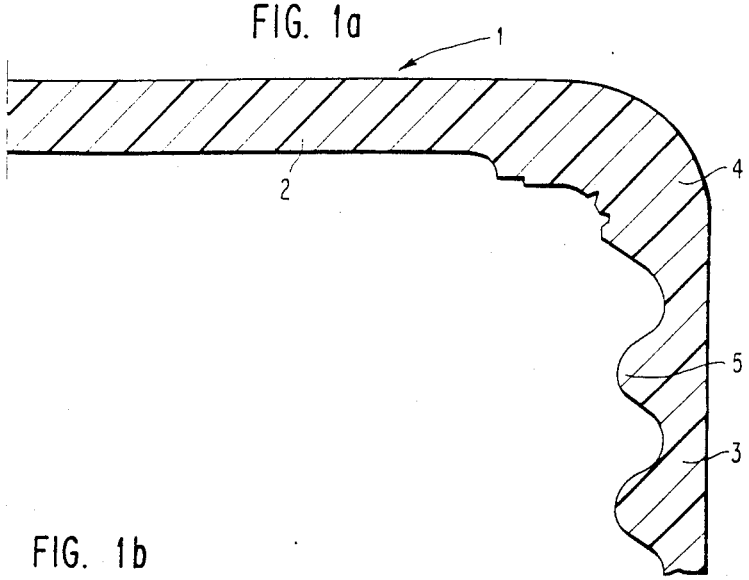
FIG. 1*a* is a sectional view showing an example of the plastic cap according to the present invention.
Figure 1B:
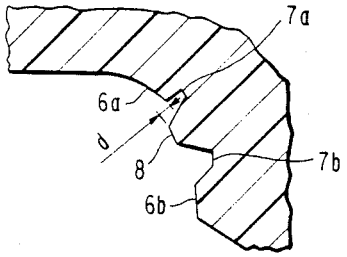
FIG. 1*b* is an enlarged view of the sealing projection in FIG. 1*a*.

Referring to FIG. 1 illustrating the sectional structure of the plastic cap according to the present invention, this cap 1 comprises a top plate 2 and a skirt 3, which are integrally formed of a plastic material, and a corner portion 4 is present between them. A female screw 5 for clamping the cap to the vessel mouth is formed on the inner circumferential face of the skirt 3.

In the corner portion 4 or the vicinity thereof, annular receiving seats 6*a* and 6*b* are provided for substantially exact engagement with the upper edge or peripheral edge of the vessel mouth and an annular projection 8 protrudes between these receiving seats 6*a* and 6*b* with annular grooves 7*a* and 7*b* formed between said seats and said projection. This sealing projection 8 is characterized in that the sealing projection 8 inwardly protrudes by a very small distance d from the face including the receiving seats 6*a* and 6*b*.

Figure 2:
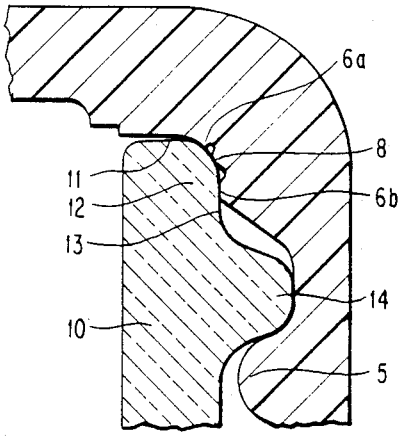
FIG. 2 is a sectional view illustrating the clamping and sealing state between the cap shown in FIG. 1 and a vessel mouth.
Figure 3B:
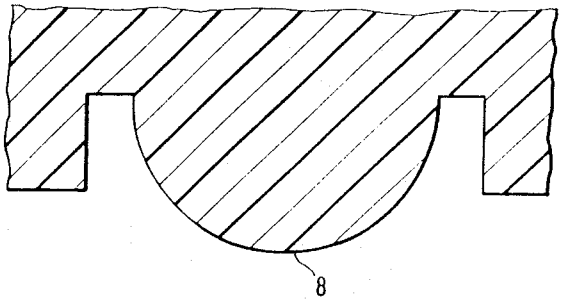
FIGS. 3*a*–3*d* are enlarged sectional views showing several examples of the sealing projection of the cap.
Figure 3D:
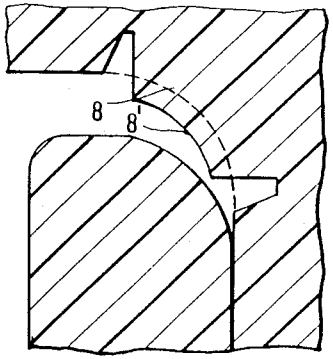
Figure 3A:
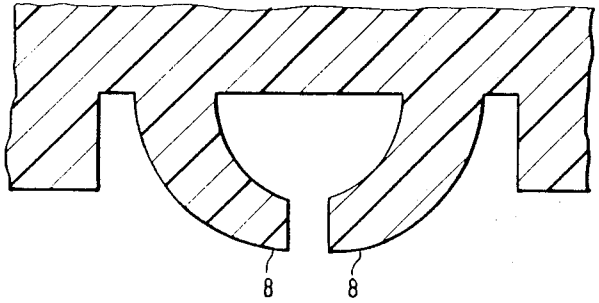
Figure 3C:
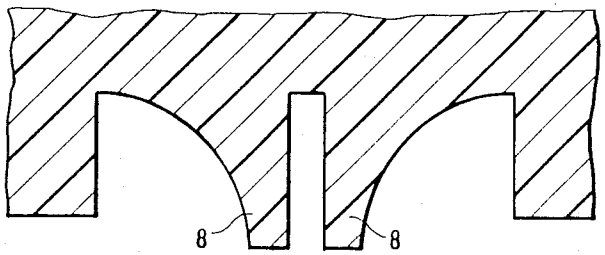

Referring to FIG. 2 illustrating the state of engagement between the plastic cap and the vessel mouth, the vessel mouth 10 has an upper edge 11, a corner 12 and a peripheral edge 13, and a male screw 14 for sealing and opening the cap 1 is formed below the peripheral edge. In the embodiment illustrated in FIGS. 1 and 2, the receiving seat 6*a* is exactly engaged with the top edge of the vessel mouth, and the receiving seat 6*b* is exactly engaged with the peripheral edge 13 of the vessel mouth. The sealing projection 8 is engaged with the corner 12 of the vessel mouth.

According to the present invention, the female screw 5 of the cap is engaged with the male screw 14 of the vessel mouth and the cap 1 is turned to clamp the cap 1 to the vessel mouth 10, whereby the corner 12 of the vessel mouth is first engaged with the sealing projection 8 and the projection 8 is compressed. The grooves 7*a* and 7*b* present on both the sides of the projection 8 allow compression deformation of the projection 8 and sealing is completed in the state where the volume of the portion 9 inwardly projecting from the face including the receiving seats 6*a* and 6*b* in the projection 8 is pressed into the grooves 7*a* and 7*b* (in this state, the receiving seat 6*a* is substantially exactly engaged with the upper edge 11 of the vessel mouth and the receiving seat 6*b* is substantially exactly engaged with the peripheral edge 13 of the mouth vessel). Because of the presence of the receiving seats 6*a* and 6*b*, the projection 8 is compression-deformed only by the very small distance d. Accordingly, plastic deformation is hardly caused in the projection 8 and reduction of the sealing pressure with the lapse of time is extremely small, and a sealing pressure not only at the time of sealing but also at the time of re-sealing. Accordingly, in the present invention, excellent sealing characteristics, especially an excellent pressure-resistant sealing property and an excellent reduced-pressure sealing property, can be obtained. Furthermore, since the vessel mouth is engaged with the sealing projection only by the pressure generated by slight compression deformation of the projection, from the start of the opening operation the pressure is gradually released and occurrence of troubles such as blow-off of the content and spring-out of the cap is effectively prevented.

In view of the durable sealing pressure, it is preferred that the shape of the section of the sealing projection 8 in the present invention be substantially trapezoidal when the projection is seen in the state where the inner part of the cap is located above, and it also is preferred that the sectional shape of the grooves 7*a* and 7*b* be invertedly trapezoidal. In the case where the inner pressure is low or reduced-pressure sealing is carried out, good sealing is attained by a small sealing pressure, and therefore, a shape having a high restoring property, as shown in FIG. 3, can be adopted.

More specifically, FIG. 3 illustrates an example of the sealing projection 8 having a sectional shape other than the trapezoidal sectional shape. FIG. 3-A shows a sealing projection 8 having a hollow semi-circular sectional shape, which is rich in the cushioning and restoring properties, FIG. 3-B shows a sealing projection 8 having a semi-circular sectional shape, which comes next to the sealing projection having a trapezoidal sectional shape in the sealing force, FIG. 3-C shows a sealing projection 8 having a hollow Mt. Fuji-like sectional shape, which is another example having an excellent cushioning property, and FIG. 3-D shows a sealing projection 8 having a top surface 8' which is exactly in accord with the surface, to be sealed, of the vessel mouth. In each case, the sealing projection 8 is characterized in that the projection 8 is formed through the grooves 7*a* and 7*b*.

The size of the protrusion of the sealing projection 8 from the face including the receiving seats 6*a* and 6*b* may be small, and in view of the combination of the durable sealing pressure and the venting property, it is preferred that the size of the protrusion be generally 3 to 2000 μm and especially 10 to 500 μm. It also is preferred that the width of the top end of the sealing projection 8 be generally smaller than 2000 μm and especially in the range of from 5 to 500 μm. Furthermore, it is preferred that the taper angle ($\theta$) of the trapezoidal projection 8 be generally −70° to 70° and especially 30° to 60°.

A single sealing projection 8 or a plurality of sealing projections 8 can be formed for the corner 4. The sealing projection 8 is formed so that the projection 8 is engaged with the corner 12 of the vessel mouth, as shown in FIGS. 1 and 2. However, this embodiment is most preferred because the engagement with the vessel mouth is performed assuredly even if the vessel mouth has a dimensional error. However, the sealing projection 8 can be formed so that the projection 8 is engaged with the upper edge 11 of the vessel mouth (this embodiment is especially suitable for sealing under a reduced pressure or sealing of a content maintained under vacuum, or the sealing projection 8 can be formed so that the projection 8 is engaged with the peripheral edge 13 of the vessel (this embodiment is especially suitable for sealing of a content having an autogeneous pressure).

Figure 4A:
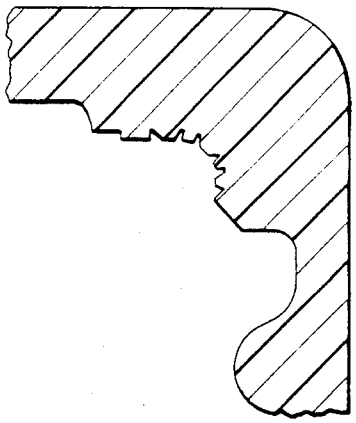
FIG. 4*a* is a sectional view illustrating another example of the plastic cap according to the present invention.
Figure 4B:
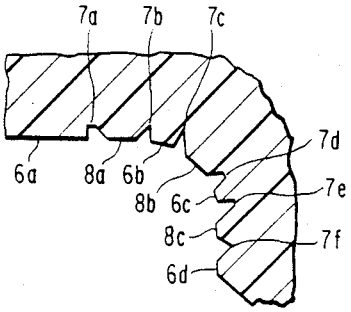
FIG. 4*b* is an enlarged view of the sealing portion of FIG. 4*a*.

Referring to FIG. 4 illustrating an example of the plastic cap having a plurality of annular sealing projections, three sealing projections, that is, a first sealing projections to be engaged with the upper edge 11 of the vessel mouth, a second sealing projection 8*b* to be engaged with the corner 12 of the vessel mouth and a third sealing projection 8*c* to be engaged with the peripheral edge 13 of the vessel mouth, are formed on the corner 4 of this cap. More specifically, the first projection 8*a* is arranged between the receiving seat 6*a* to be engaged with the upper edge of the vessel mouth and the receiving seat 6*b* to be engaged with the upper portion of the corner of vessel mouth with grooves 7*a* and 7*b* on opposite sides of projection 8*a*, the second projection 8*b* is arranged between the receiving seat 6*b* to be engaged with the upper portion of the corner of the vessel mouth and the receiving seat 6*c* to be engaged with the lower portion of the corner of the vessel mouth with grooves 7*c* and 7*d* on opposite sides of projection 8*c*, and a third projection 8*c* is arranged between the receiving seat 6*c* to be engaged with the lower portion of the corner of the vessel mouth and the receiving seat 6*d* to be engaged with the peripheral edge of the vessel through grooves 7*e* and 7*f*.

Each of these projections 8*a*, 8*b* and 8*c* inwardly protrudes by a very small distance from the face including the receiving seats 6*a*, 6*b*, 6*c* and 6*d*, and these projections undergo compression deformation and a required durable sealing pressure is obtained. In the cap of this embodiment, even if any one of these three projections is flawed at the step of forming the cap or a flaw is accidentally formed in the portion to be sealed in the vessel mouth, sealing is assuredly accomplished and leakage is completely prevented.

In the plastic cap of the present invention, it has been found that if the thickness of the corner 4 to be sealed with the vessel mouth is made larger than that of the top plate 2, an excellent pressure-resistant sealing force or reduced-pressure sealing force can be obtained. For example, when the cap is sealed to the vessel mouth with a sealing force of 78.4 kgf, a durable sealing pressure of 23 kgf is obtained, but it has been found that if upward deformation of the top plate 2 is allowed with an inner pressure of 3.0 kgf, the durable sealing pressure is increased to 40 kgf. Similarly, in case of the cap shown in FIG. 4, a durable sealing pressure of 0.5 kgf is produced between the first sealing projection and the vessel mouth, but it has been found that if downward deformation is allowed under a reduced pressure of 1.0 kgf/cm$^2$, the durable sealing pressure is increased to 10kgf. The thickness (t1) of the top plate is generally 0.5 to 3 mm, and it is preferred that the thickness (t2) of the corner be such that the t2/t1 ratio be from 1 to 2, especially from 1.3 to 1.7.

The plastic cap of the present invention can be formed of an optional resin. For example, there can be mentioned olefin resins such as polyethylene, polypropylene, a propylene/ethylene copolymer and a propylene/butene-1 copolymer, acrylonitrile/styrene/-butadiene (ABS) resins, impact-resistant styrene resins, acrylic resins, and nylon resins. In view of the sealing capacity and moldability, it is preferred that the cap be formed of a high-density polyethylene or polypropylene resin.

Formation of the cap can be easily accomplished by injection molding of a resin as mentioned above by using a mold having a shape corresponding to the shape of the cap.

The cap of the present invention can be used not only as an ordinary screw cap but also as a pilfer-proof cap by forming a known pilfer-proof mechanism on the lower end of the skirt. The pilfer-proof mechanism is not particularly critical. For example, there can be used a pilfer-proof mechanism comprising a bridge formed on the lower end of the skirt through a perforation and a peripheral band for engagement with the chin of the vessel mouth, which is connected to the bridge.

EFFECT OF THE INVENTION

According to the present invention, by adoption of a structure in which the sealing projection is compression-deformed by a very small distance, plastic deformation is prevented and a high durable sealing pressure can be obtained If the cap of the present invention is used for sealing an inner pressure vessel, an excellent pressure-resistant sealing property and an excellent venting property (gas-venting property) are obtained, and if the cap of the present invention is used for a reduced-pressure vessel, an excellent reduced-pressure sealing property can be obtained.

EXAMPLE

Figure 5:
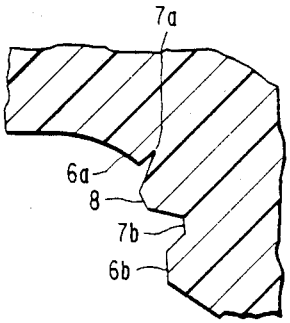
FIGS. 5 and 6 are sectional views illustrating sample caps 1 and 2 used in the example, respectively.
Figure 6:
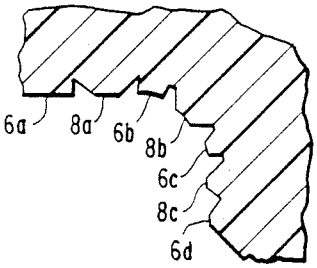
Figure 7:
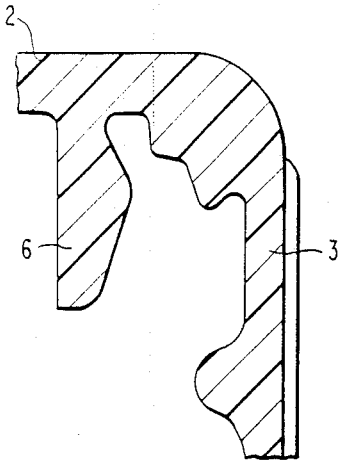
FIG. 7 is a sectional view showing a comparative cap used in the example.

A plastic cap (sample cap 1) having one sealing projection and having a diameter of 28 mm, as shown in FIG. 5, a plastic cap (sample cap 2) having three sealing projections and having a diameter of 28 mm, as shown in FIG. 6, and a resin cap (comparative cap) of the bottle inner diameter-sealing type having a diameter of 28 mm, as shown in FIG. 7, were formed by an injection molding machine. The molding was carried out by using HDPE having MFR of 5 at a resin temperature of 220° C. The molding machine used was Model OKM60/210A supplied by Okuma-Krausmaffei.

With respect to each of the so-formed plastic caps, the pressure resistance test, venting property test and reduced-pressure resistance test described below were carried out.

1. TEST METHOD (1) Pressure Resistance Test (Test of Notification No. 20 of the Welfare Ministry)

A pressure-resistant PET bottle having a mouth diameter of 28 mm and an inner volume of 1.5 l was packed with 4 vol. of citric acid-sodium bicarbonate and the bottle was capped at a top load of 40 kg and a clamping torque of 16 kgf-cm by using a one-head capper supplied by Alcoa. Then, the warm water immersion test was carried out at 45° C. for 2 hours and the presence or absence of leakage was checked.

(2) Venting Property Test

Figure 8:
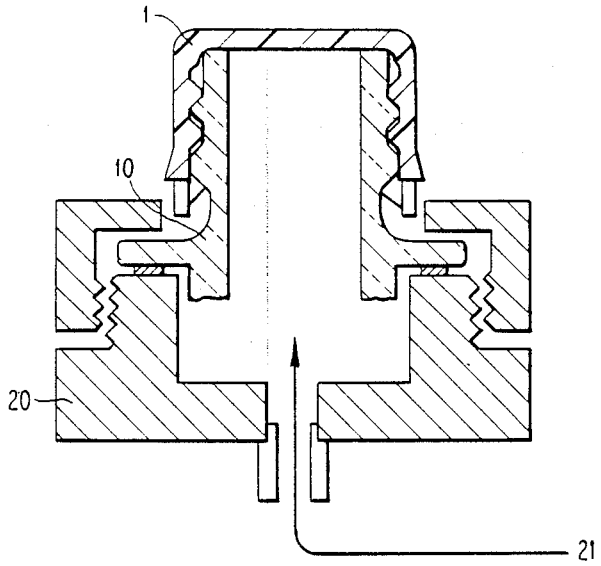
FIG. 8 is a sectional view illustrating a vent angle-measuring apparatus used at the venting property test in the example.

By using each of the above-mentioned caps, capping was carried out in the same manner as described in (1) above, and the mouth portion of the bottle was cut out and set as shown in FIG. 8. The bottle mouth portion was gradually opened and the angle (venting gas) at which nitrogen gas began to escape was measured.

(3) Reduced-Pressure Resistance Test

A heat-resistant T-bottle (the mouth portion was crystallized) having a mouth diameter of 28 mm and an inner capacity of 1.5 l was fully filled with warm water maintained at 85° C. By using each of the abovementioned caps, the bottle was capped in the same manner as described in (1) above and was then water-cooled. The sample was allowed to stand at 40° C. in the vertical state for 1 week and at 5° C. in the vertical state for 1 week, and this cycle was repeated 2 times. The presence or absence of vacuum break was checked.

2. Results

The results of the pressure resistance test, venting property test and reduced-pressure resistance test are shown in Table 1 through 3.

TABLE 1

Results of Pressure Resistance Test

| | Number of Leaks (45° C. - 2 hours) |
|---|---|
| Sample cap 1 | 0/10 |
| Sample cap 2 | 0/10 |
| Comparative cap | 0/10 |

TABLE 2

Results of Venting Property Test

| | Vent Angle |
|---|---|
| Sample angle | 30° |
| Sample 2 | 30° |
| Comparative cap | 130° |

TABLE 3

Results of Reduced-Pressure Resistance

| | Number of Leaks (2 cycles) |
|---|---|
| Sample cap | 0/20 |

TABLE 3-continued

| Results of Reduced-Pressure Resistance | |
|---|---|
| | Number of Leaks (2 cycles) |
| Sample cap 2 | 0/20 |
| Comparative cap | 0/20 |

What is claimed is:

1. A plastic cap comprising a top plate and an annular skirt depending from a peripheral edge of the top plate, said top plate and skirt being integrally formed of a plastic material, and means on an inner circumferential face of said skirt for clamping the cap to a vessel mouth, wherein said cap has a pair of spaced apart receiving seats in a corner of the cap between said top plate and skirt adapted to be substantially exactly engaged with the top edge and peripheral edge respectively of the vessel mouth and at least one sealing projection protruding between said receiving seats with a pair of grooves between said projection and said seats respectively, said projection protruding a very small distance beyond the faces of said receiving seats and having a top face with a surface complementary to the surface of the vessel mouth whereby sealing is effected by the pressure generated by compression deformation of the sealing projection.

2. A plastic cap as set forth in claim 1, wherein the sealing projection has a substantially trapezoidal shape and the groove has an inverted trapezoidal sectional shape.

3. A plastic cap as set forth in claim 2, wherein the taper angle of the trapezoidal sealing projection is −70° to 70°.

4. A plastic cap as set forth in claim 1, wherein the sealing projection has a substantially hollow semicircular shape.

5. A plastic cap as set forth in claim 1, wherein the sealing projection inwardly protrudes by 3 to 1000 μm from the face of the receiving seat.

6. A plastic cap as set forth in claim 1, wherein the width of the top end of the sealing projection is 5 to 500 μm.

7. A plastic cap as set forth in claim 1, wherein the thickness of the corner is larger than thickness of the top plate.

8. A plastic cap as set forth in claim 1, which is formed of a olefin resin.

9. A plastic cap as set forth in claim 1, wherein a first additional sealing projection is provided on said top plate for engagement with the upper edge of the vessel mouth and a second additional sealing projection is provided on said skirt for engagement with the peripheral edge of the vessel mouth.

* * * * *